US007434319B2

(12) United States Patent
Tsai-Lian

(10) Patent No.: US 7,434,319 B2
(45) Date of Patent: Oct. 14, 2008

(54) CIRCULAR CUTTER

(76) Inventor: Chen Lin Tsai-Lian, No. 6, Mingde St., Huatan Township, Changhua County 503 (TW)

( * ) Notice: Subject to any disclaimer, the term of this patent is extended or adjusted under 35 U.S.C. 154(b) by 412 days.

(21) Appl. No.: 11/194,792

(22) Filed: Aug. 1, 2005

(65) Prior Publication Data

US 2007/0022615 A1 Feb. 1, 2007

(51) Int. Cl.
*B26B 29/00* (2006.01)
*B26B 25/00* (2006.01)

(52) U.S. Cl. ..... 30/292; 30/319; 30/307; 30/164.95; 83/478

(58) Field of Classification Search ..... 30/319, 30/164, 95, 114, 307, 365, 2, 151, 162, 286, 30/289, 292, 293; 83/478
See application file for complete search history.

(56) References Cited

U.S. PATENT DOCUMENTS 4,432,137 A * 2/1984 Okada ..... 30/292
RE32,501 E * 9/1987 Okada ..... 30/292
5,493,781 A * 2/1996 Saito ..... 30/162
6,094,824 A * 8/2000 Takeshita ..... 30/276
6,282,794 B1 * 9/2001 Cho et al. ..... 30/151
6,327,783 B1 * 12/2001 Ming ..... 30/292
6,460,254 B1 * 10/2002 Mori et al. ..... 30/286
7,073,263 B2 * 7/2006 Kawasaki ..... 30/292
7,204,023 B2 * 4/2007 Chang ..... 30/319
2004/0187318 A1 * 9/2004 Mathieu et al. ..... 30/319

* cited by examiner

*Primary Examiner*—Ehud Gartenberg
*Assistant Examiner*—Bharat C Patel
(74) *Attorney, Agent, or Firm*—Banger Shia

(57) ABSTRACT

A circular cutter comprises a circular blade mounted to a front end of a handle via a shaft assembly, in the handle is disposed a slide member for controlling a hood having a T-shaped hole, the T-shaped hole is located correspondingly to a center of the circular blade and arranged outside of the shaft assembly, when the hood draws back under the control of the slide member, a surface of an object to be cut will press against the hood, so as to make the shaft assembly deviate left or right freely within the T-shaped hole, and therefore, both a left hand user and a right hand user can use the same circular cutter.

7 Claims, 9 Drawing Sheets

CIRCULAR CUTTER

BACKGROUND OF THE INVENTION

1. Field of the Invention

The present invention relates to a round cutter (such as plastic slice, leather piece, woodiness piece, scrip, cardboard, etc.), and more particularly to a round cutter for increasing cut angle automatically and easy operation.

2. Description of the Prior Art

A manual circular cutter for linearly cutting sheet-like articles (such as plastic sheet, leather sheet, wood sheet, cardboard, etc.) appears on the marks nowadays, and generally comprises a round blade pivotally mounted to a handle, and a hood slideably arranged perpendicular to the axes of the handle. The effective cutting area of the circular cutter can be closed or open by moving the hood (the circular blade can contact the object to be cut after being blocked by the hood). The cutting tool is quite easily operated and practical, but also has some disadvantages.

For example:

Firstly, the effective cutting area of the circular cutter can be adjusted by the slide of the hood in the axial direction of the handle of the circular cutter, but effective cutting area of the circular cutter is vertical to the forefront of the axes of the handle of the cutting tool, and therefore the effective cutting angle of the circular cutter is not large enough in consideration of the gripping direction that the user holds the handle.

Secondly, the conventional cover is slidable in the direction of the axes of the handle of the circular cutter, therefore, the effective cutting area of the round cutter begins from the forefront thereof. If the object to be cut is kind of thick, the handle of the circular cutter should be arranged in a vertical manner to the object to be cut, so that the maximum cutting depth can be achieved.

To solve the abovementioned shortcomings, another manual circular cutter appeared on the market (as shown in FIG. 1), which comprises a circular blade 10 pivotally mounted to the front end of the handle 13. On the hood 11 is formed a slant slot 111 located correspondingly to the pivotal shaft 101 of the circular blade 10. The control button 12 for controlling the hood 11 is to be pressed by the user's thumb, the slanting direction of the slot 111 must be set according to the user's habit. This manual circular cutter also has its own shortcomings.

First, since the slanting direction of the slot 111 must be set according to the user's habit, a right hander and a left hander can't share the same circular cutter, and they only can choose one of the two circular cutters as shown in FIGS. 2 and 3.

Second, the adjustable length of the hood 11 is determined by the button 12, and if the adjustable length of the hood 11 is not enough, then the effective cutting depth of the circular blade 10 will be affected adversely.

The present invention has arisen to mitigate and/or obviate the afore-described disadvantages.

SUMMARY OF THE INVENTION

The primary objective of the present invention is to provide a circular cutter that can be used comfortably and easily both by a left hander and a right hander. The hood is defined with a T-shaped hole located correspondingly to the center of the circular blade and arranged outside of the shaft of the circular blade. When the hood is drawn back by the slide member, the T-shaped hole allows the hood to move left and right freely whatever the user uses the circular cutter with right hand or left hand.

The secondary objective of the present invention is to provide a circular cutter that has a wider cutting angle and a deeper cutting depth. When the hood is, drawn back by the slide member, the T-shaped hole allows the hood to move left and right freely whatever the user uses the circular cutter with right hand or left hand. Furthermore, the deviation space A of the handle is big enough for allowing the hood to move left and right freely so as to provide enough cutting area for the circular cutter, and the edge of the hood will abut against the object to be cut smoothly as the cutting depth increases, thus helping stabilize the cutting operation.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
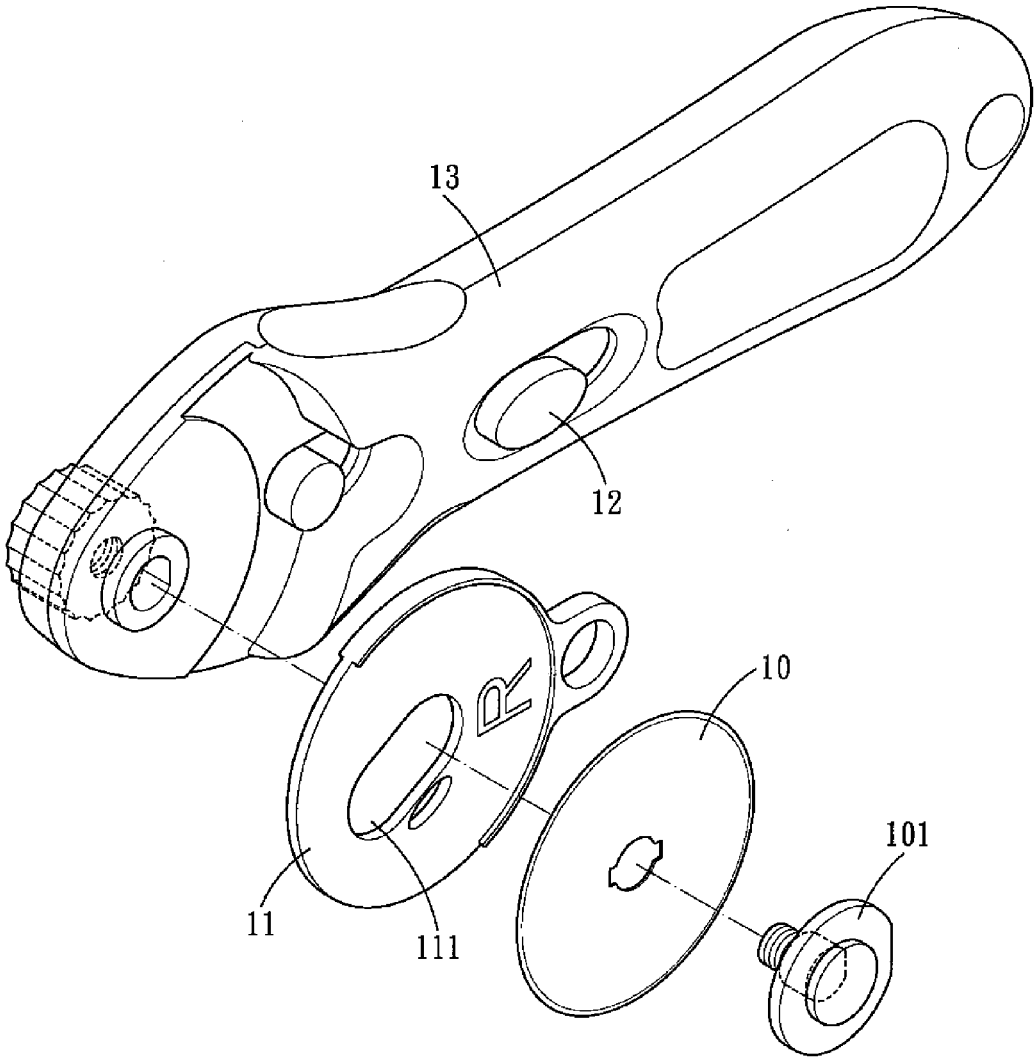
FIG. 1 PRIOR ART
FIG. 1 is an exploded view of a circular cutter of prior art.
Figure 2:
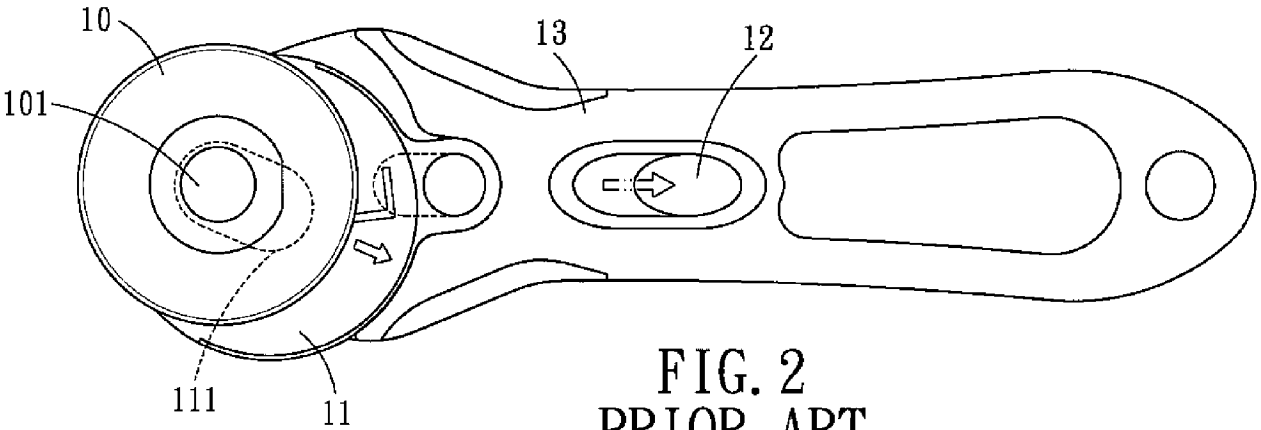
FIG. 2 PRIOR ART
FIG. 2 is a conventional circular cutter which is designed for a left hand user.
Figure 3:
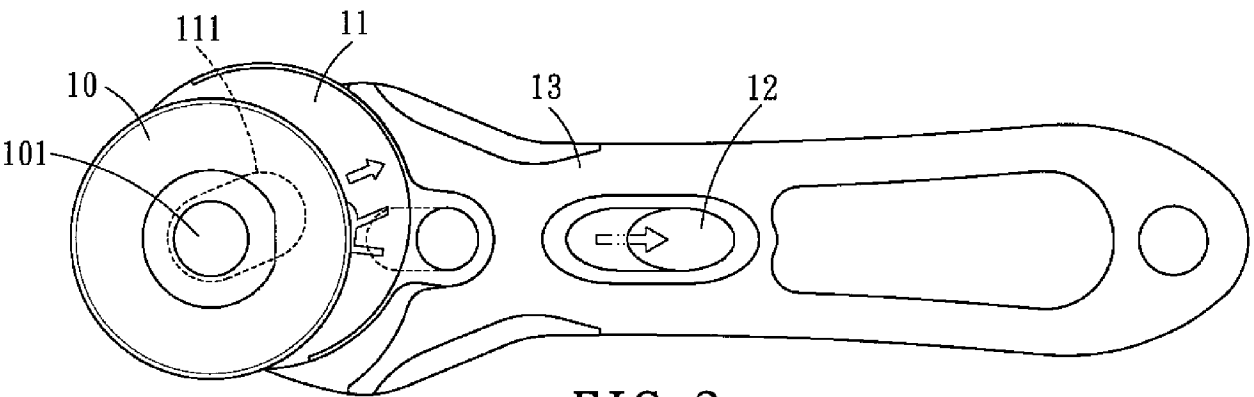
FIG. 3 PRIOR ART
FIG. 3 is a conventional circular cutter for a right hand user.
Figure 4:
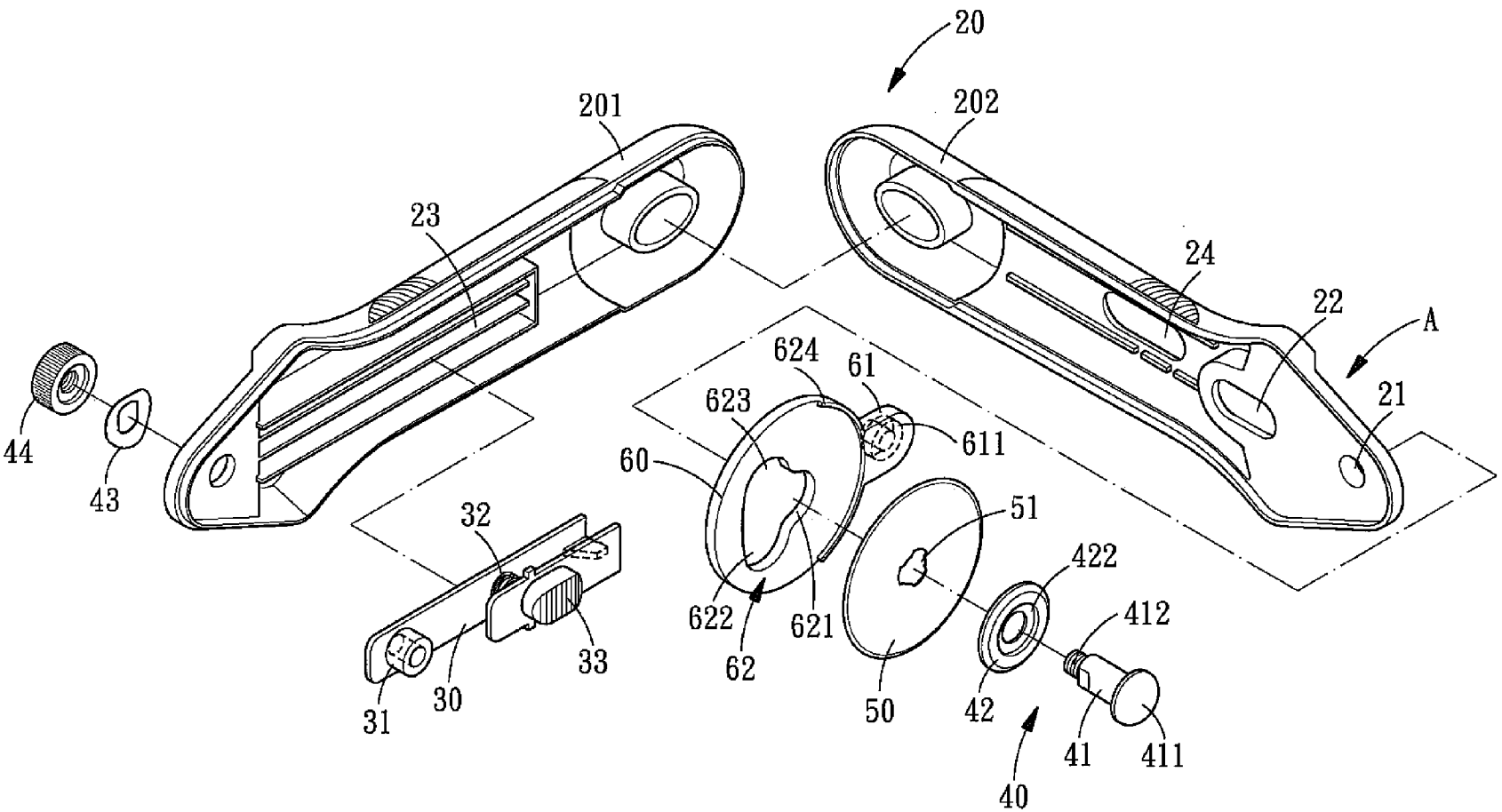
FIG. 4 is an exploded view of a circular cutter in accordance with a first embodiment of the present invention.
Figure 5:
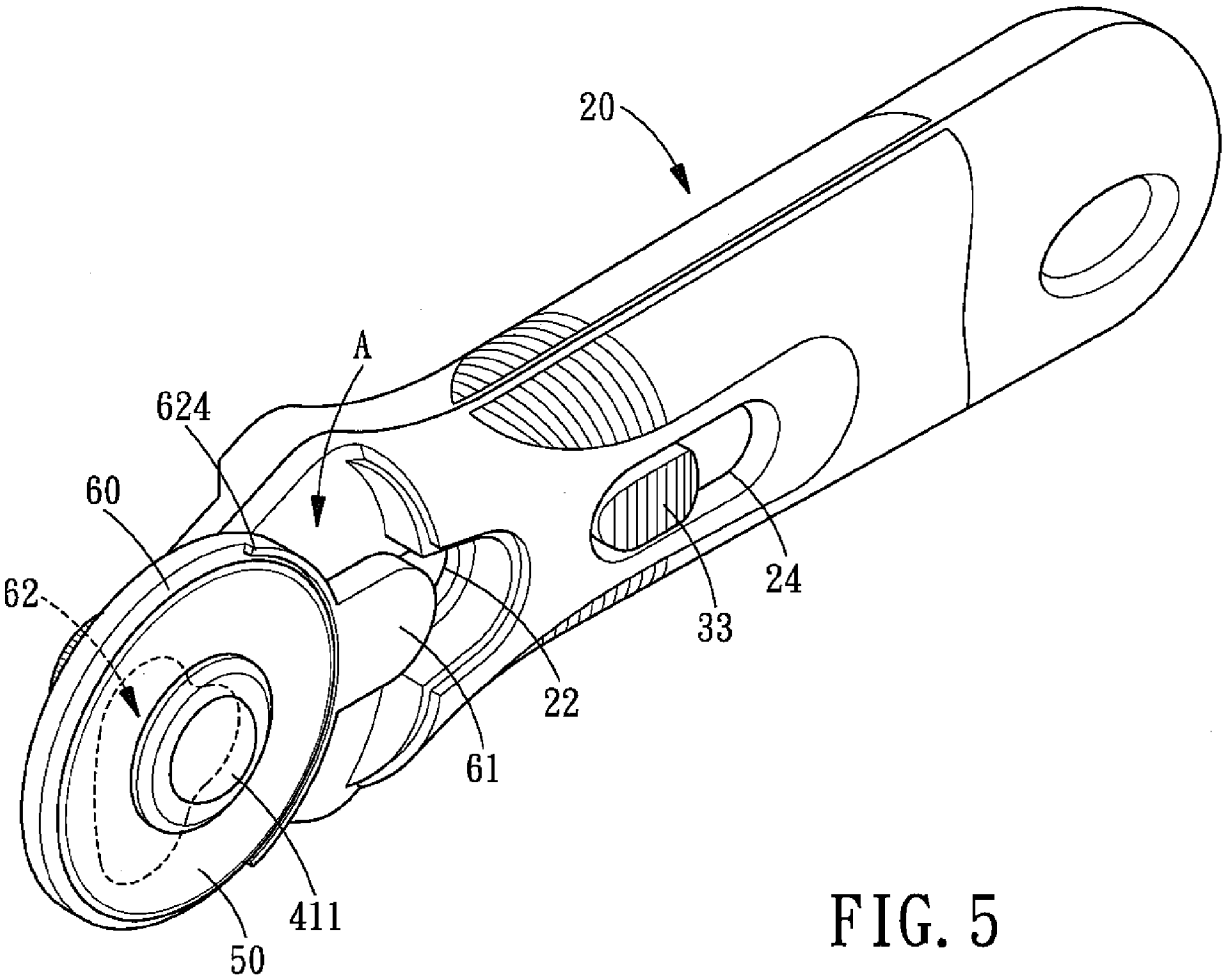
FIG. 5 is an assembly view of the circular cutter in accordance with the first embodiment of the present invention.
Figure 6:
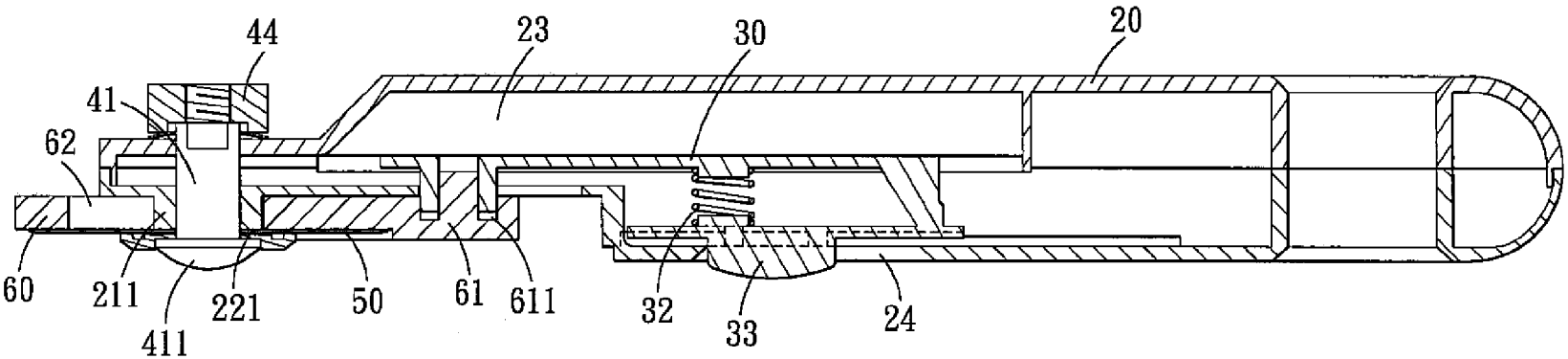
FIG. 6 is a cross sectional view of showing the cutting state of the circular cutter in accordance with the first embodiment of the present invention.
Figure 7:
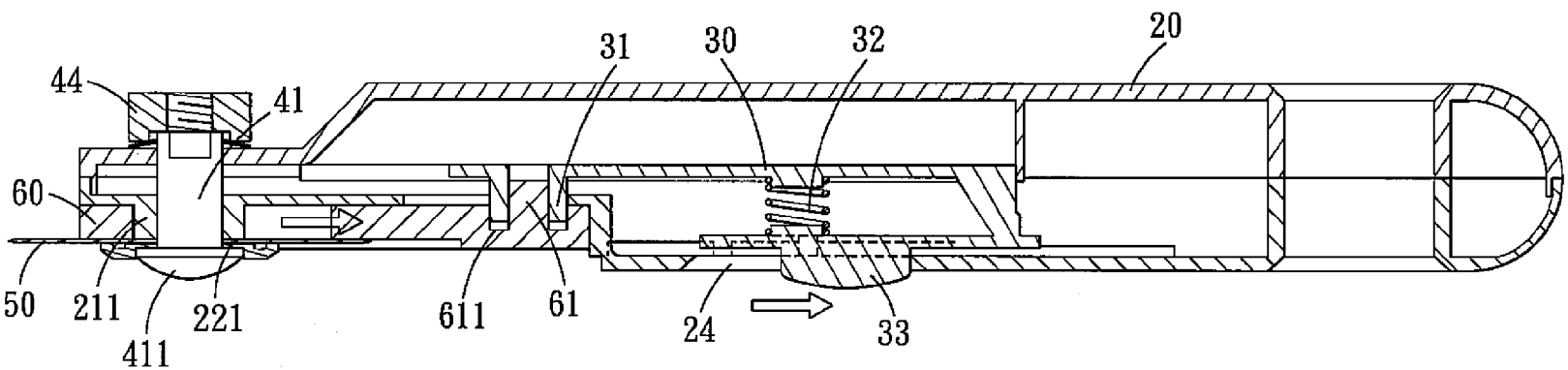
FIG. 7 is a cross sectional view of showing the non-cutting state of the circular cutter in accordance with the first embodiment of the present invention.
Figure 8:
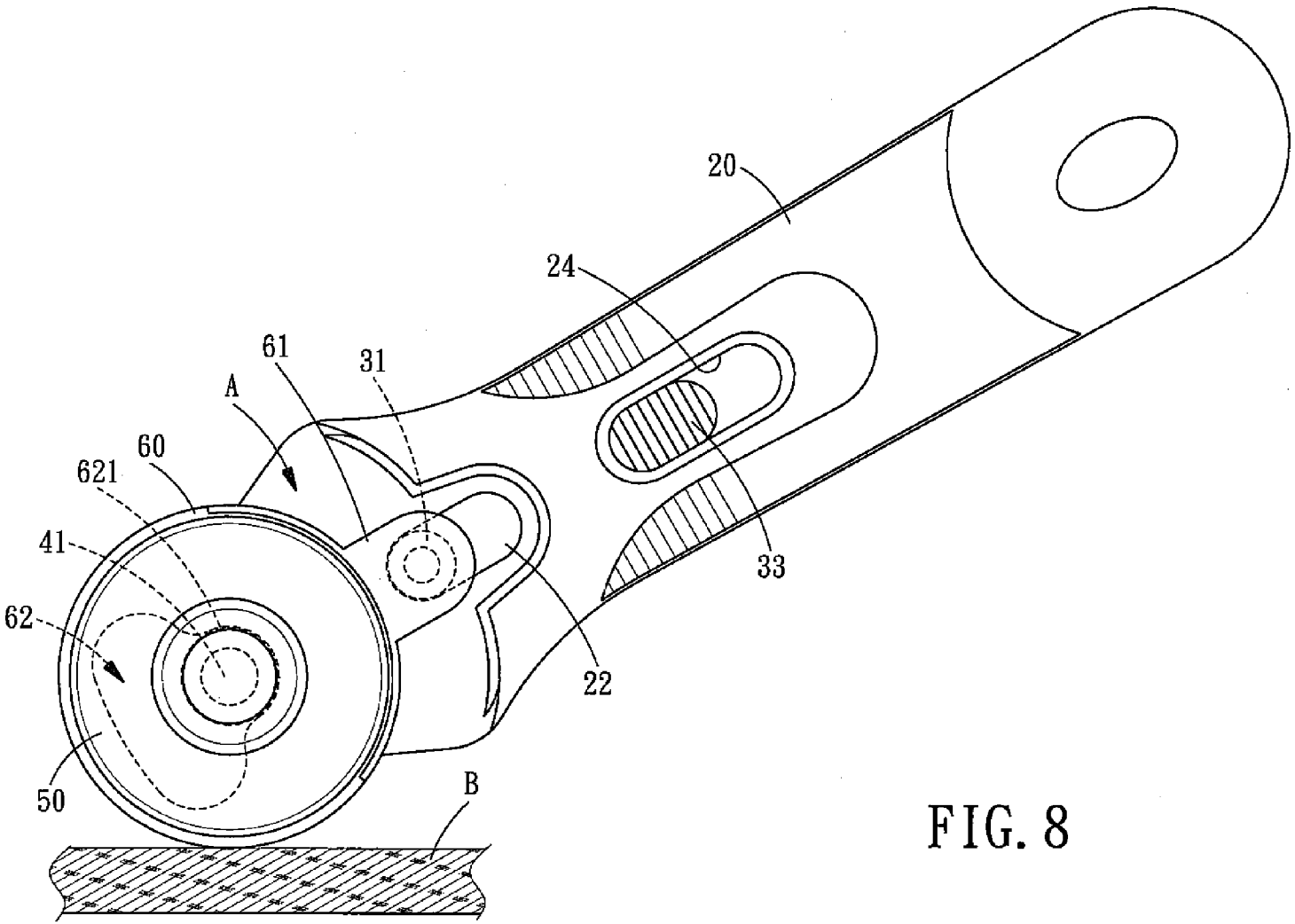
FIG. 8 shows a non-cutting state of the circular cutter in accordance with the first embodiment of the present invention.
Figure 9:
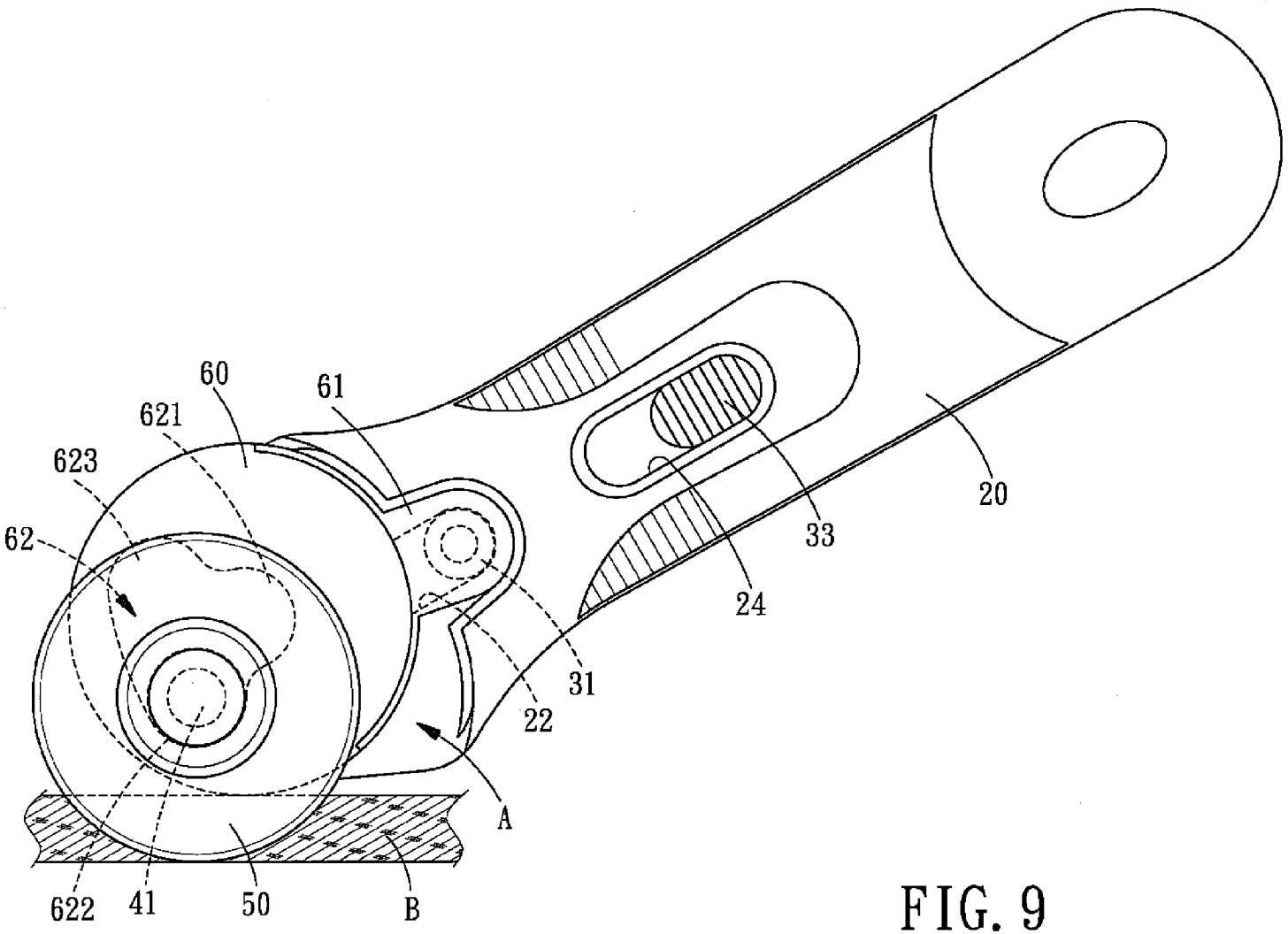
FIG. 9 shows the cutting state of the circular cutter in accordance with the first embodiment of the present invention.

Referring to FIGS. 4, 5 and 6, a circular cutter in accordance with the present invention is shown and comprises a handle 20, a slide member 30, a shaft assembly 40, a circular blade 50 and a hood 60.

The handle 20 comprises a first housing 201 and a second housing 202. At the front end of the second housing 202 is formed a deviation space A, and at the front end of the handle 20 are formed a pivotal hole 21, an elongated slot 22 and a protective cover 221 is arranged on the outer edge of the pivotal hole 21. The first housing 201 of the handle 20 is interiorly formed with a slide groove 23 for cooperating with the elongated slot 22, and the slide groove 23 extends in the extending direction of the handle 20. On the second housing 202 is further defined an elongated limit hole 24 located correspondingly to the slide groove 23 of the first housing 201.

The slide member 30 is slideably disposed in the slide groove 23 of the handle 20 and is formed at the front end thereof with a protrusion 31 that is to be inserted in the elongated slot 22 of the handle 20. A press button 33 is connected to the mid portion of the slide member 30 by a spring 32 and is confined in the elongated limit hole 24 of the handle 20.

The shaft assembly 40 comprises a shaft 41, a first washer 42, a second washer 43, and a nut 44. The shaft 41 has a head portion 411 formed at an end thereof and has a plurality of threads 412 formed at another end thereof for meshing with the nut 44. The shaft 41 and the nut 44 are inserted in the pivotal hole 21 (the shaft 41 is covered with the protective cover 211) in such a manner that the first washer 42 and the second washer 43 are disposed outside of the first and second housings 201 and 202 of the handle 20. The washer 43 has elasticity and serves to clamp the respective components of the handle and to prevent the nut 44 from getting loose. The first washer 42 is formed with an annular abutting portion 422 for abutting against the head portion 411 of the shaft 41, so that the circular blade 50 can be clamped more tightly through the cooperation between the annular abutting portion 422 of the first washer 42 and the second washer 43.

The circular blade 50 is defined with a pivotal hole 51 through which the circular blade 50 is mounted on the shaft 41 of the shaft assembly 40.

The hood 60 has a shape corresponding to the shape of the circular blade 50 and is formed with an extension 61 for mating with the slide member 30. On the extension 61 is defined a locating slot 61 for engaging with the protrusion 31 of the slide member 30. The hood 60 is further formed with a T-shaped hole 62 for engaging with the shaft 41 of the shaft assembly 40. The T-shaped hole 62 includes a central locating area 621 for mating with the center of the circular blade 50, a left gap 622 and a right gap 623. The T-shaped hole 62 is provided for insertion of the shaft 41 (the shaft 41 is covered with the protective cover 211) and is located between the circular blade 50 and the handle 20. The deviation space A of the handle 20 provides a big enough space for allowing the hood 60 to move left and right freely therein, and at the rear edge of the hood 60 is formed a protective flange 624 for keeping the circular blade 50 from the user.

For a better understanding of the present invention, its operation and function, references should be made to FIGS. 5-9. When the circular cutter is not in use, the slide member 30 is kept in the front of the slide groove 23 of the handle 20, the protrusion 31 is kept in the front of the elongated slot 22 of the handle, and the press button 33 is kept in the front of the elongated limit hole 24. At this moment, the hood 60 covers the circular blade 50 completely, and the shaft 41 is engaged in the central locating area 621 of the T-shaped hole 62, and thus the circular blade 50 is well protected.

The hood 60 can be prevented from moving left and right when an external force is applied on both sides of the hood 60, due to the shaft 41 is confined in the central locating area 621 of the T-shaped hole 62.

When want to use the circular cutter, the user can make the slide member 30 move backward by pushing the press button 33. When the slide member 30 moves backward within the slide groove 23, the protrusion 31 will move the hood 60 backward within the elongated slot 22 by pushing the extension 61. In this way, the hood 60 will withdraw from the circular blade 50, and the shaft 41 will be located between the left and right gaps 622 and 623 of the T-shaped hole 62.

At this moment, whatever a left hander or a right hander uses the circular cutter, the hood 60 can be pushed toward whichever side of the left and right gaps to meet the user's habit once a side of the hood 60 presses against the object B to be cut, due to the shaft 41 is located between the left and right gaps 622 and 623 of the T-shaped hole 62. That is to say that both left hander and a right hander can use the same circular cutter. In addition, the edge of the hood 60 will abut against the object B smoothly, thus helping stabilize the cutting operation, and the used portion of the circular blade 50 is still covered by the hood 60.

When the hood 60 is drawn back by the slide member 30, the T-shaped hole 62 allows the hood 60 to move left and right freely whatever the user uses the circular cutter with right hand or left hand, therefore, the device of the present invention is ergonomic. Furthermore, the deviation space A of the handle 20 is big enough for allowing the hood 60 to move left and right freely to provide enough cutting area for the circular cutter, and the edge of the hood 60 will abut against the object B smoothly as the cutting depth increases, thus helping stabilize the cutting operation.

Figure 10:
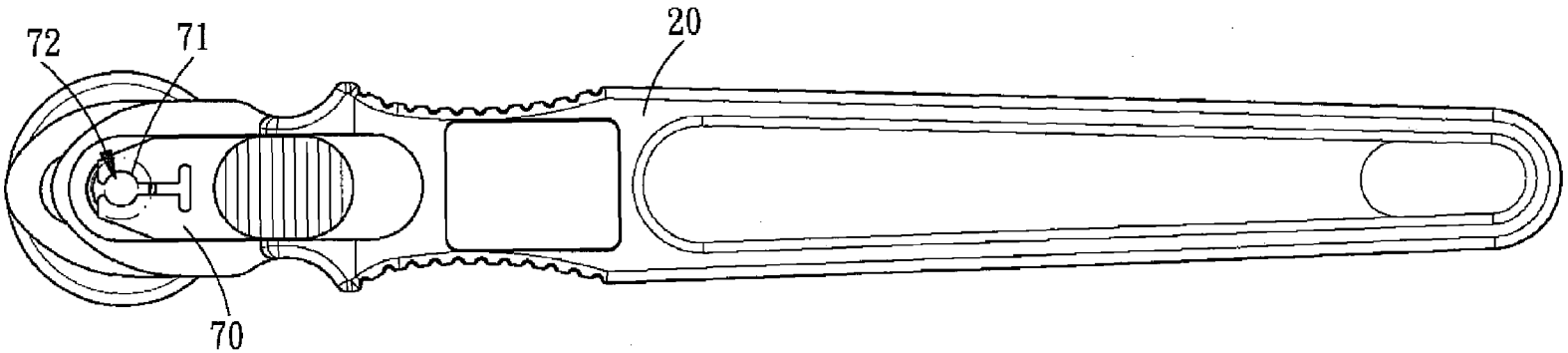
FIG. 10 is a front view of a circular cutter in accordance with a second embodiment of the present invention.
Figure 11:
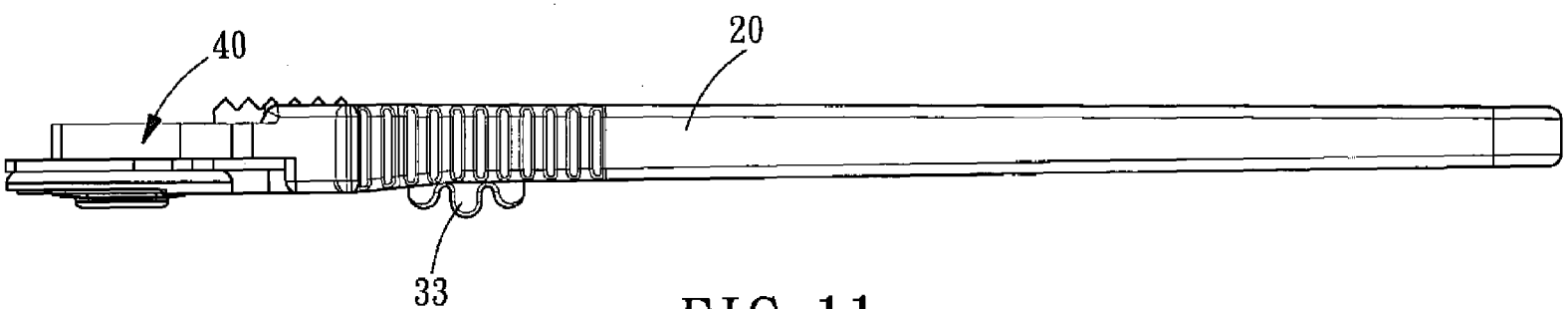
FIG. 11 is a side view of the circular cutter in accordance with the second embodiment of the present invention.
Figure 12:
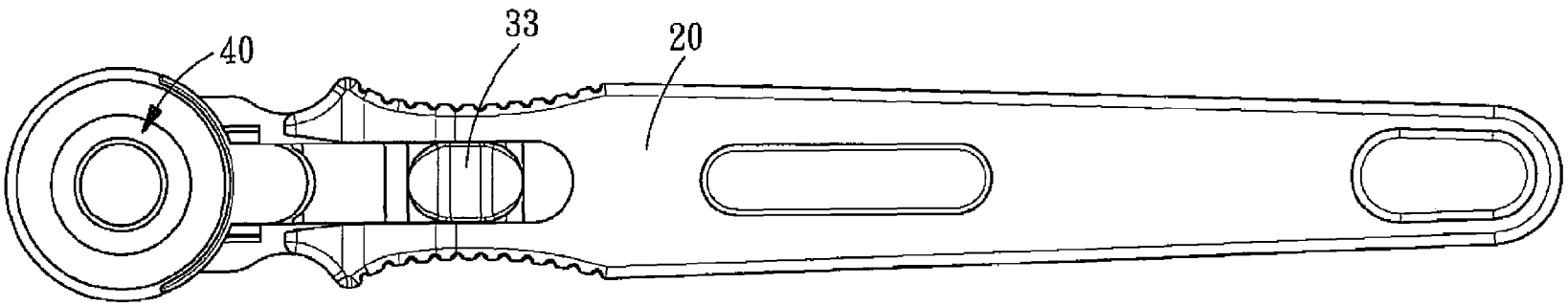
FIG. 12 is a back view of the circular cutter in accordance with the second embodiment of the present invention.

Referring to FIGS. 10-12, which show another embodiment of the present invention, the nut 40 of the shaft assembly 40 can be changed to a slide retainer 70 slidealby mounted on the handle 20. At the front end of the retainer 70 is formed an elastic retaining cavity 71, and at another end of the shaft 41 is formed an annular groove 72 for mating with the retaining cavity 71 of the slide retainer 70. The slide retainer 70 allows quick assembly of the shaft assembly 40.

While we have shown and described various embodiments in accordance with the present invention, it should be clear to those skilled in the art that further embodiments may be made without departing from the scope of the present invention.

What is claimed is:

1. A circular cutter comprising a circular blade mounted to a front end of a handle via a shaft assembly, in the handle is disposed a slide member for controlling a hood having a T-shaped hole, the T-shaped hole is located correspondingly to a center of the circular blade and arranged outside of the shaft assembly, when the hood draws back under the control of the slide member, a surface of an object to be cut will press against the hood, so as to make the shaft assembly deviate within the T-shaped hole;

wherein the shaft assembly comprises a shaft and a slide retainer, the shaft has a head portion, the slide retainer is slideably mounted on the handle, at the front end of the retainer is formed a elastic retaining cavity, and at another end of the shaft is formed an annular grove for mating with the retaining cavity of the slide retainer, the slide retainer allows quick assembly of the shaft assembly.

2. The circular cutter as claimed in claim 1, wherein the handle is formed at its front end with a space, a pivotal hole and an elongated slot, in the handle is formed with a slide groove for cooperating with the elongated slot, the slide groove extends in an extending direction of the handle, and the handle is further defined an elongated limit hole that is located correspondingly to the slide groove;

the slide member is slideably disposed in the slide groove of the handle and is formed at a front end thereof with a protrusion to be inserted in the elongated slot of the handle, and the slide member is confined in the elongated limit hole of the handle by a press button;

the shaft assembly comprises a shaft and a nut that are inserted in the pivotal hole of the handle;

the circular blade is defined with a pivotal hole through which the circular blade is mounted on the shaft of the shaft assembly;

the hood has a shape corresponding to a shape of the circular blade and is formed with an extension for mating with the slide member, on the extension is defined a locating slot for engaging with the protrusion of the slide member, the T-shaped hole is formed on the hood for engaging with the shaft of the shaft assembly, the T-shaped hole includes a central locating area for positioning the center of the circular blade, and includes a left gap and a right gap, the T-shaped hole is provided for insertion of the shaft and is located between the circular blade and a head portion of the shaft, the space of the handle provides a big enough space for allowing the hood to move left and right freely therein.

3. The circular cutter as claimed in claim 2, wherein the handle comprises a first housing and a second housing, at the front end of the second housing is formed the deviation space, the first housing is interiorly formed with the slide groove for cooperating with the elongated slot, and on the second housing is defined an elongated limit hole located correspondingly to the slide groove of the first housing.

4. The circular cutter as claimed in claim 2, wherein a protective cover is arranged on an outer edge of the pivotal hole of the handle, and the shaft of the shaft assembly is covered with the protective cover.

5. The circular cutter as claimed in claim 2, wherein the press button is connected to a mid portion of the slide member by a spring and is confined in the elongated limit hole of the handle.

6. The circular cutter as claimed in claim 2, wherein the shaft assembly comprises the shaft, a first washer, a second washer, and the nut, the shaft has the head portion formed at an end thereof and has a plurality of threads formed at another end thereof for meshing with the nut, the shaft and the nut are inserted in the pivotal hole of the handle in such a manner that the first washer and the second washer are disposed outside of the first and second housings of the handle.

7. The circular cutter as claimed in claim 6, wherein the second washer has elasticity and serves to clamp the circular blade and to prevent the nut from getting loose.

* * * * *